US007334554B2

(12) United States Patent
Galvin

(10) Patent No.: US 7,334,554 B2
(45) Date of Patent: Feb. 26, 2008

(54) PISTON

(76) Inventor: George F Galvin, 9 Christchurch Road, Sidcup, Kent (GB) DA15 7HG ( * ) Notice: Subject to any disclaimer, the term of this patent is extended or adjusted under 35 U.S.C. 154(b) by 12 days.

(21) Appl. No.: 10/552,981

(22) PCT Filed: Apr. 5, 2004

(86) PCT No.: PCT/GB2004/001483

§ 371 (c)(1),
(2), (4) Date: Jun. 28, 2006

(87) PCT Pub. No.: WO2004/090306

PCT Pub. Date: Oct. 21, 2004

(65) Prior Publication Data

US 2006/0243240 A1 Nov. 2, 2006

(30) Foreign Application Priority Data

Apr. 12, 2003 (GB) ..... 0308524.8

(51) Int. Cl.
*F02B 75/38* (2006.01)

(52) U.S. Cl. ..... 123/193.6; 123/48 B; 123/78 B

(58) Field of Classification Search ..... 123/193.6, 123/48 A–48 B, 78 A–78 BA
See application file for complete search history.

(56) References Cited

U.S. PATENT DOCUMENTS

| | | | | |
|---|---|---|---|---|
| 2,323,742 A | | 7/1943 | Webster | |
| 4,016,841 A | * | 4/1977 | Karaba et al. | 123/78 B |
| 4,031,868 A | | 6/1977 | Karaba et al. | |
| 4,137,873 A | | 2/1979 | Caswell, Sr. | |
| 4,469,055 A | | 9/1984 | Caswell | |
| 5,755,192 A | * | 5/1998 | Brevick | 123/78 B |
| 5,769,042 A | | 6/1998 | Popadiuc | |
| 5,970,944 A | | 10/1999 | Kawamura | |
| 6,223,703 B1 | | 5/2001 | Galvin | |
| 6,907,849 B2 | | 6/2005 | Galvin | |

FOREIGN PATENT DOCUMENTS

| | | | |
|---|---|---|---|
| DE | 1813140 | | 6/1970 |
| DE | 3021093 | | 12/1981 |
| DE | 3139686 | | 4/1983 |
| DE | 3612842 | | 10/1987 |
| GB | 2318151 A | | 4/1998 |
| JP | 406017665 A | * | 1/1994 |
| WO | WO 96/34190 | | 10/1996 |
| WO | WO 00/77367 A2 | | 12/2000 |

* cited by examiner

*Primary Examiner*—Marguerite McMahon
(74) *Attorney, Agent, or Firm*—Baker & Daniels LLP

(57) ABSTRACT

A piston includes a spring acting between the piston crown and a connecting rod so as to bias the connecting rod away from the crown of the piston. The spring may include a pair of disc springs supported at their edge portions. The support may be a substantially annular support including a pair of rings fixed to the edge portions of the disc springs and an annular band that engages the rings and permits relative movement between the band and the rings.

15 Claims, 2 Drawing Sheets

PISTON

BACKGROUND

This invention relates to a piston for an internal combustion engine.

A conventional internal combustion engine employs a crankshaft to convert the reciprocating motion of the piston (s) into output torque to propel a vehicle or act upon any other load. The crankshaft is inefficient in its ability to convert the power available from the fuel combustion into usable output torque. This is because combustion of the fuel/air mixture takes place a number of degrees before the top dead centre (TDC) position of the piston, dependent upon engine speed and load. The ignited fuel/air pressure forces cannot produce output torque when the piston is either before or at TDC as the connecting rod and the crank pin are producing reverse torque before TDC and are practically in a straight line at TDC so that there is no force component tangential to the crank circle. This results in most of the available energy being lost as heat. If ignition takes place too early, most of the pressure generated is wasted trying to stop the engine (as this pressure tries to force the piston in the opposite direction to which it is traveling during the compression stroke); and, if left too late, the pressure is reduced due to the increasing volume above the piston as it starts its descent for the power stroke. The optimum maximum pressure point varies from engine to engine, but is around 12° after TDC on average.

SUMMARY OF THE INVENTION

The specification of my UK patent 2 318 151 relates to a piston and connecting rod assembly for an internal combustion engine. The assembly comprises a piston, a connecting rod, and a spring, the connecting rod having a first end operatively associated with the piston for movement therewith, and a second end connectible to a rotary output shaft. The spring acts between the piston and the connecting rod to bias the connecting rod away from the crown of the piston. The piston is movable towards the second (small) end of the connecting rod by a distance substantially equal to the cylinder clearance volume height. One result of using a spring is that the assembly has a resonant frequency, the advantages of which are described in the specification of my International patent application WO 00/77367. This assembly will be referred to throughout this specification as an energy storage piston.

In use, ignition is timed, by conventional timing means to take place at a predetermined time before TDC, so that the expanding gases formed by the ignition combustion force the piston to descend rapidly within the cylinder during the power stroke. Prior to reaching TDC, however, the pressure in the cylinder will build up to a high value, and the piston is forced towards the crank pin, against the force of the spring. This compresses the spring, and increases the volume above the piston, causing a reduction in pressure and temperature in the cylinder. The lowered temperature reduces radiation losses and the heat lost to the cooling water and subsequently the exhaust, with the pressure being shared equally between the cylinder clearance volume and the spring. This energy stored in the spring is released when the piston has passed TDC, and leads to the production of increased output torque. This is achieved as the spring pressure is now combined with the cylinder pressure after TDC. A large proportion of this stored energy would otherwise have been lost as heat, owing to the fact that the fuel/air mixture must be ignited before TDC, which is a result of the requirement for the ignited fuel/air to reach maximum pressure by about 12° after TDC for optimum performance.

One problem with the type of energy storage piston disclosed in the above-mentioned patent specifications is the necessity to have relative movement between the connecting rod small end and the piston crown in order to store energy in the spring arrangement mounted between these two parts. This problem has manifested itself in wear of the spring arrangement and/or adjacent parts, this wear being due to the failure of the assembly to maintain rigid axial alignment between the moving parts. This misalignment can cause heavy wear, and sometimes leads to seizures between adjacent parts, particularly when the piston is on full load.

The specification of my International patent application WO 01/75284 describes an energy storage piston that has improved alignment properties. This piston incorporates a spring, which is integrally formed with the piston, is configured as a bellows spring, and is made of titanium.

The disadvantages of this bellows spring piston are that it is difficult to manufacture, and can suffer from excessive stress forces if overloaded. Thus, if the bellows spring is manufactured from an annular block of titanium by machining internal and external slots, these cannot be done without computer numerical control (CNC), and this is a costly exercise as it requires a considerable time input to generate the correct cross-section of the bellows to achieve a functional piston. Moreover, the machining of the slots results in a considerable wastage of expensive titanium, and each spring will have to be specifically designed for a given piston and its application. Furthermore, because of the curved internal and external portions of the bellows spring and the requirement that the opposite faces of adjacent "leaves" of the spring must be contoured in order to spread the stress concentrations, the gaps between adjacent "leaves" are relatively large—of the order of 3 mm—and this leads to excessive stress problems if overloaded. Thus, a bellows spring is produced which has a relatively few "leaves" per unit length, and these must take up the large stress forces to which the piston is subjected in use. Accordingly, the stress per "leaf is relatively high, and this can lead to premature failure of the spring. An additional disadvantage of this type of bellows spring is that, in order to attempt to achieve the required stress and deflection figures, it occupies a comparatively large space, making piston design difficult. Thus, space that is required for other piston components has to compete with the space occupied by the bellows spring. Throughout this specification, the term "leaves" should be taken to mean those parts of a bellows spring that form the corrugations of the spring.

Alternatively, if individual leaves of the spring are formed by stamping, and the leaves are diffusion bonded together to form a bellows spring, a more cost-effective bellows spring can be produced, but this still suffers from excessive stress problems owing to the relatively large gaps between the leaves which are inherent in a bellows spring having curved internal and external end portions and non-parallel leaf walls. Space problems also occur for the same reasons as outlined above.

The specification of my UK patent application 0216830.0 describes an energy storage piston incorporating a spring acting, in use, between the piston and an associated connecting rod so as to bias the connecting rod away from the crown of the piston. The spring is configured as a bellows spring having a plurality of substantially parallel leaves defining the corrugations of the bellows spring. The internal and external end portions of the spring that connect the leaves are of rectangular configuration, and the gaps between adjacent leaves are defined by substantially parallel surfaces.

This spring has the advantages of being easier to manufacture than earlier types of bellows spring, and it does not suffer to the same extent from overstressing. It does, however, still occupy a lot of space within a piston, which results in difficulties in piston design.

The specification of my UK patent application 0218893.6 describes a piston incorporating spring means acting, in use, between the piston and an associated connecting rod so as to bias the connecting rod away from the crown of the piston. The spring means is configured as a generally circular cushion spring located substantially in the region of the piston crown and extending over substantially the entire transverse cross-section of the piston, the spring means being such as to permit the crown of the piston to move axially relative to the connecting rod.

The disadvantage of this cushion spring is that it needs to be manufactured from two identical members whose edges must be bonded together. Electron beam welding is the preferred bonding method, but this process results in the material in the weld region being taken above its Beta Transus temperature, which results in the material becoming brittle, thereby shortening its useful working life.

The aim of the invention is to provide an improved piston, and in particular an improved energy storage piston.

The present invention provides a piston incorporating spring means acting, in use, between the piston and an associated connecting rod so as to bias the connecting rod away from the crown of the piston, wherein the spring means is constituted by a pair of disc springs whose circumferential edge portions are supported and separated by a substantially annular support member, the spring means being located substantially in the region of the piston crown and extending over substantially the entire transverse cross-section of the piston, the spring means being such as to permit the crown of the piston to move axially relative to the connecting rod.

In a preferred embodiment, the support member is constituted by respective rings fixed to the circumferential edge portions of the disc springs, and by an annular band formed with curved support surfaces for rolling engagement with the rings. Advantageously, the rings and the annular band are made of hardened steel, and preferably the annular band is formed with oil lubrication holes.

Preferably, the spring is made of titanium, such as titanium 10-2-3.

In a preferred embodiment, the piston further comprises a carrier positioned within the piston, the carrier being slidably mounted within the piston for axial movement relative thereto, and being connected to the connecting rod in such a manner that the spring means permits the crown of the piston to move axially relative to the carrier. Advantageously, the carrier is made of aluminium.

Preferably, the carrier is provided with a domed surface, which is engageable with the disc spring remote from the piston crown, and the piston crown is provided with a domed surface, which is engageable with the disc spring adjacent to the piston crown. Advantageously, the domed surfaces are mirror images of one another.

Preferably, the carrier is slidably mounted within a sleeve fixed to the inside of the cylindrical wall of the piston at that end thereof remote from the crown, and the sleeve is made of a bronze/aluminium alloy.

BRIEF DESCRIPTION OF THE DRAWINGS

The invention will now be described in greater detail, by way of example, with reference to the drawings, in which.

DETAILED DESCRIPTION OF THE INVENTION

Figure 1:
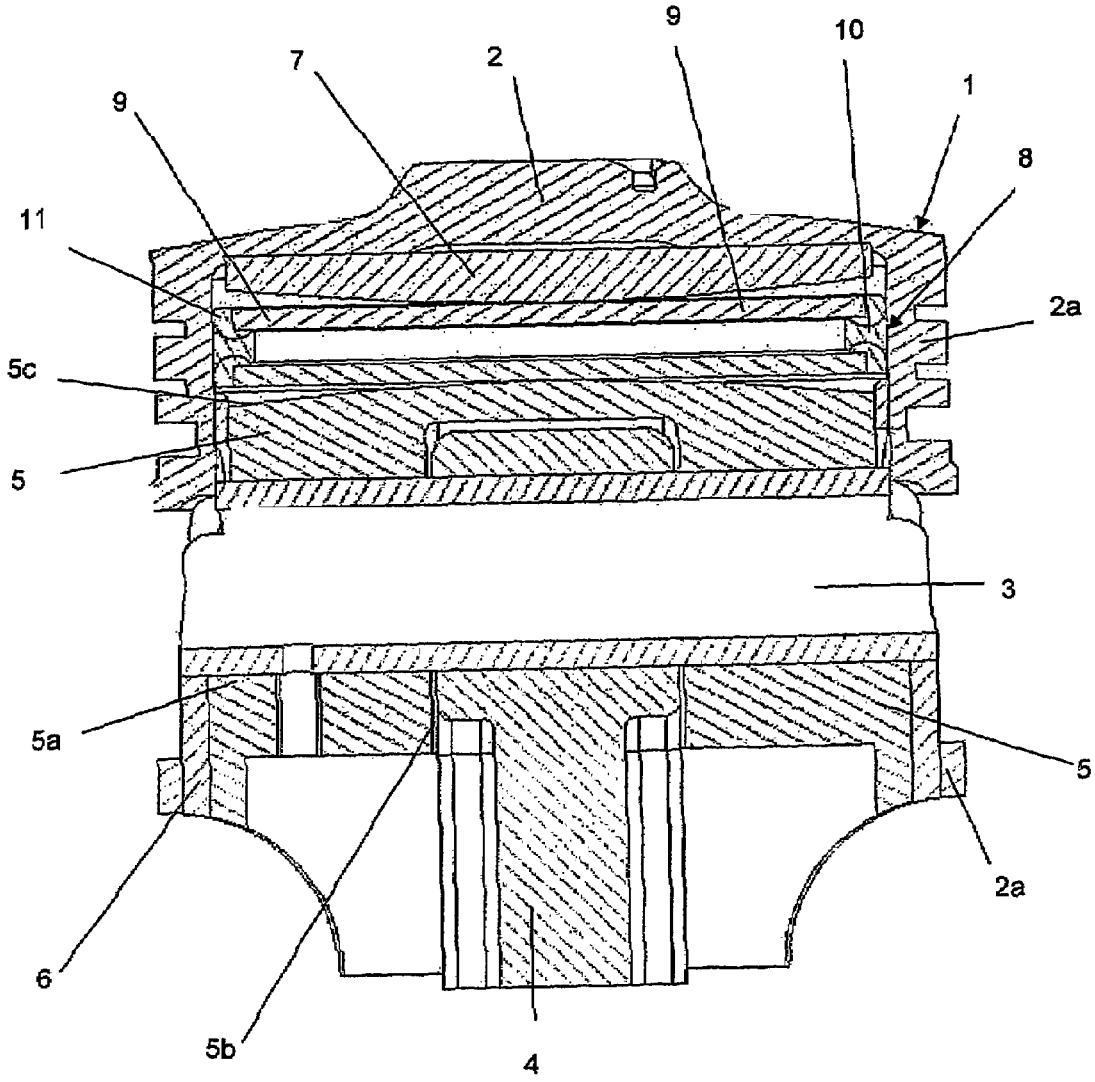
FIG. 1 is a sectional view of an energy storage piston constructed in accordance with the invention.

Referring to the drawings, FIG. 1 shows a hollow piston 1 of an internal combustion engine, the piston being reciprocable in a cylinder (not shown) lined with cast iron or steel in a conventional manner. The piston 1 is made of aluminium, and has a crown 2 having a downwardly depending annular sleeve 2*a* which defines the peripheral cylindrical surface of the piston. In use, the piston 1 turns a crankshaft (not shown) by means of a gudgeon pin 3, a connecting rod 4, and a crank pin (not shown), all of which can be made of titanium, aluminium, steel, a magnesium alloy, a plastics material or any other suitable material. The gudgeon pin 3 is an interference fit within a cylindrical aperture 5*a* formed within a cylindrical carrier 5 made of aluminium, and is held axially in place by conventional circlips (not shown) or any other suitable means. This prevents axial rotation and lateral movement of the gudgeon pin 3 within the carrier 5. A sleeve 6 made of a bronze/aluminium alloy is fixed to the lower portion of the annular piston sleeve 2*a* by means of pair of aluminium discs (not shown). The sleeve 6 provides a bearing surface for slidably supporting the carrier 5, as is described below. The sleeve 6, which forms a bearing surface for the carrier 5, is made of this material because its coefficient of expansion is similar to that of the aluminium from which the carrier and the piston 1 are made. Moreover, it prevents aluminium-to-aluminium sliding contact that could lead to galling to the contacting surfaces.

The connecting rod 4 passes through a generally rectangular aperture 5*b* formed in the carrier 5, and is connected to the gudgeon pin 3. The rectangular aperture 5*b* is at right-angles to the cylindrical aperture 5*a*. A spring assembly 8 is positioned within the piston 1, between a downwardly facing, domed member 7 positioned within the piston adjacent to the piston crown 2, and an upwardly facing domed surface 5 of the carrier 5. The domed member 7 is a push fit within the hollow piston 1 adjacent to the piston crown 2.

Figure 2:
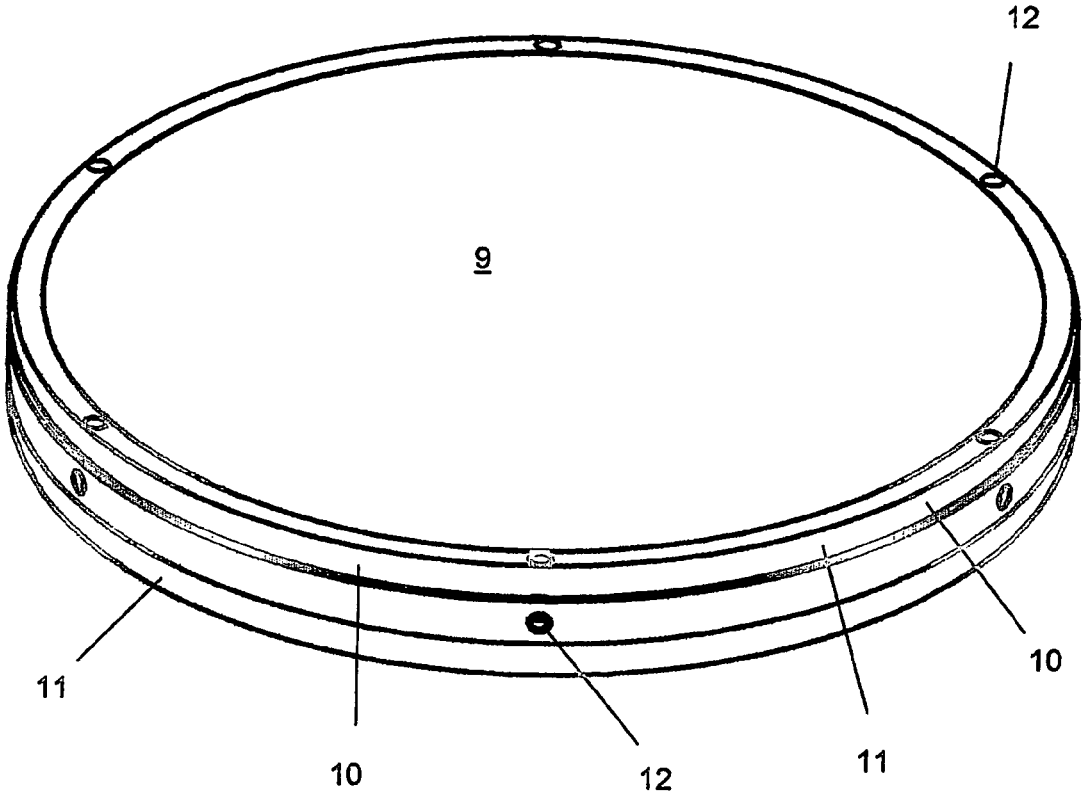
FIG. 2 is an enlarged view of part of the spring of FIG. 1, and shows the spring in an uncompressed configuration.

The spring assembly 8 is formed from two identical flat disc springs 9 made of titanium 10-2-3, a hardened steel band 10 and a pair of hardened steel rings 11 (see FIG. 2). The steel rings 11 are friction fitted around the rims of the disc springs 9 so as to provide rolling contact with complementary curved surfaces 10*a* defined by the steel band 10. The band 10 and the rings 11 thus separate and support the disc springs 9.

The lower end of the carrier 5 is fixed by the gudgeon pin 3 to the connecting rod 4, and the piston 1 is axially movable relative to the carrier, and hence is relatively movable with respect to the gudgeon pin 3 and the crank pin. The arrangement is such that the piston crown 2 is able to move towards the crank pin by a maximum distance approximately equal to the cylinder clearance volume height (the distance between the mean height of the piston crown 2 and the mean height of the top of the combustion chamber). The spring assembly 8 thus biases the connecting rod 4 away from the piston crown 2.

Horizontal and vertical lubricating holes 12 are provided in the steel band 10 so that steel-on-steel rolling action is adequately lubricated. Conventional lubricating holes (not shown) are provided in the region of a lower oil control ring (not shown), such that oil is directed above the carrier 5, which is formed with drilled oil passages (not shown), to lubricate the connecting rod small end, the gudgeon pin 3, and the area of contact of the carrier with the sleeve 6.

In use, ignition is timed, by conventional timing means (not shown), to take place at a predetermined time before TDC, so that the expanding gases formed by the ignition combustion force the piston 1 to descend rapidly within the cylinder during the power stroke. Prior to reaching TDC, however, the pressure in the cylinder will build up to a high value, and the piston 1 is forced towards the crank pin, against the force of the spring assembly 8, with respect to the carrier 5. This compresses the spring assembly 8, and increases the volume above the piston 1, causing a reduction in pressure and temperature in the cylinder.

As pressure is applied during combustion, the upper disc 9 dishes downwardly, while the lower disc dishes upwardly in a complementary fashion. The bending action of the disc springs 9 causes the steel rings 11 to rotate about their circumferential axes and roll in the curved surfaces 10*a* of the steel band 10. The displacement of the disc springs 9 allows the piston crown 2 to descend with respect to the connecting rod and the carrier 5, such that the cylinder volume above the piston 1 is doubled at maximum pressure, thereby storing energy in the spring assembly 8 that would otherwise be lost as heat through the cylinder walls. The stored energy is then released when the crank is at a more advantageous angle to generate additional torque.

The spring assembly 8 and the domed surfaces 5*c* and 7 are so configured that, at the maximum pressure of combustion, the domed surfaces fully deflect the disc springs 9 with the domed surfaces engaging substantially the entire outer surfaces of the disc springs. At the same time, the arrangement is such that the inner surfaces of the disc springs 9 just touch, thereby preventing overstressing of the disc springs, and hence possible premature failure. The maximum compression depends upon the post-ignition pressure and the crank shaft movement, and the spring assembly 8 is appropriately configured to reach the required maximum pressure before over-stressing occurs.

As the spring assembly 8 is compressed, it opposes the forces being applied due to its stiffness, this stiffness being measured in Newtons/metre displacement. The lowered temperature which results from the compression of the spring assembly 8 reduces radiation losses and the heat lost to the cooling water and subsequently the exhaust, with the pressure being shared equally between the cylinder clearance volume and the spring assembly 8. This energy stored in the spring assembly 8 is released when the piston 1 has passed TDC, and leads to the production of increased output torque. This is achieved as the energy is released by the spring assembly 8, and is combined with the cylinder pressure after TDC at a time when the crank arm is at a more advantageous angle to produce torque. A large proportion of this stored energy would otherwise have been lost as heat, owing to the fact that the fuel/air mixture must be ignited before TDC, which is a result of the requirement for the ignited fuel/air to reach maximum pressure by about 12° after TDC for optimum performance. Titanium 10-2-3 is the preferred material for making the disc springs 9, because of its mechanical and thermal properties, though other materials having similar mechanical and thermal properties could also be used.

The action of this arrangement means that, when the engine is firing normally, there will be movement of the piston 1 with respect to the connecting rod 4 (and hence to its crank pin) on every power stroke. The ignition timing of the engine is such that ignition occurs between approximately 10° and 40° before 1 DC, depending upon the engine's load and speed.

One effect of providing the energy storage spring assembly 8 is to reduce considerably the engine fuel consumption without reducing its power output. A minimum of 30% improvement can be achieved without a compression ratio adjustment, and up to 60% with compression ratio adjustment.

Not only is the efficiency of the engine improved, but the exhaust emissions are also reduced. Thus, by decreasing the fuel consumption, the quantity of emissions is reduced; by lowering the temperature of combustion (in the non-increased compression ratio case), the nitrous oxide emissions are greatly reduced; and, by increasing the efficiency of the engine, unburnt hydrocarbon emissions are reduced.

In a standard internal combustion engine, an exhaust valve is usually opened before the associated piston reaches bottom dead centre (BDC) to allow the continuing expanding gases to rush out of the exhaust, thereby assisting the entrance of a fresh charge of fuel and air into the cylinder during valve overlap (that is to say when both the inlet and outlet valves are open), such that the exhaust gases are effectively scavenged from the combustion chamber. The act of opening the exhaust valve early promotes the emission of unburnt hydrocarbons, and prevents the continuing expanding gases from providing mechanical rotation of the crankshaft, as these gases are vented to atmosphere. The use of the spring assembly 8, however, not only allows more efficient use of the fuel/air mixture, but, if used with an increased compression ratio, allows the use of a cam shaft designed such that the exhaust valve remains closed until almost BDC. The clearance volume in the cylinder will, therefore, be considerably reduced, thereby effectively clearing most of the exhaust gases from the combustion chamber without the need to release the pressure in the cylinder by opening the exhaust valve early. This late opening of the exhaust valve cam design can be applied advantageously to any engine utilising the spring assembly 8.

The use of the spring assembly 8, coupled with the mass of the engine's flywheel, gives the whole assembly a frequency (rpm) at which it is resonant. This could be used to advantage when employed in an engine designed to run at a constant speed.

The principle of increasing engine efficiency and reducing exhaust emissions is described in the specification of my UK patent 2 318 151, and the piston 1 described above thus has all the advantages of that piston.

The piston 1 described above has all the advantages of the piston described in the specification of my International patent application WO 01/75284. This piston also has advantages when compared with the improved rectangular bellows spring described in the specification of my UK patent application 0216830.0. In particular, the spring assembly 8 is much smaller than the rectangular bellows spring, so that it can be fitted into the space between the piston crown 2 and the top of the carrier 5. Moreover, being smaller, it uses considerably less titanium, and so leads to a piston having a reduced cost. Furthermore, the use of the spring assembly 8, which is located entirely at the crown end of the piston, enables the carrier 5 to be made of aluminium rather than titanium which was the case with the improved rectangular bellows spring design, thereby leading to a further materials cost reduction.

The spring assembly 8 is also much lighter than the rectangular bellows piston; and, due to the simplicity of its design, its manufacturing process is more economical, faster and simpler. Yet another advantage is that existing piston designs can easily be modified to accept the spring assembly 8, thereby permitting existing internal combustion engines to be modified to take advantage of the unproved efficiency and fuel conservation properties of the energy storage piston.

A further advantage of the piston 1 described above is that the carrier 5 is firmly held in axial alignment within the piston body. Thus, when a non-axial load is imparted to the carrier 5 due to the departure of the connecting rod 4 from axial alignment with the piston 1, the carrier will be subject to a substantial sideways thrust. Because of the close fit of the piston 1 within the cylinder bore, the close sliding fit of the carrier 5 within the sleeve 6, the carrier is maintained firmly in axial alignment with the piston body. Consequently, the carrier 5 has substantially improved resistance to wear.

The essence of the piston described above is that the spring assembly 8 allows the spring rate to be progressive, thereby allowing, pro rata, more deflection for lighter loads. Consequently, it is more compatible with the normal loading on the piston of a conventional automobile internal combustion engine, so that the economic advantage will be more pronounced at lower and medium loads rather than at high loads. Alternatively, the spring assembly 8 could be designed to favour a heavy load application if necessary.

Another advantage of the inwardly domed surfaces contacting the disc springs 9 is that more vertical space is available within the body of the piston, thereby enabling the efficient inclusion of all necessary components, without sacrificing strength or reliability.

Additional advantages of using titanium for making the disc springs 9, are:

1. Although titanium is more dense than aluminium, less actual material is required because of its superior strength, so that the weight of the piston 1 is comparable in weight with an aluminium piston design.
2. The problem with galling experienced with untreated titanium can be eliminated by surface treatment, such that its coefficient of friction when oil lubricated is less than that of oil-lubricated carbon steel.
3. By using the spring assembly 8, a larger spring force can be applied without exceeding full load stress figures, hence extending its endurance.

Although the energy storage piston described above forms part of an internal combustion engine, it will be apparent that it could be used, with advantage, in other devices such as a compressor for a refrigerator or a pump. The action of a reciprocating compressor is such that the compression stroke is the working stroke, and the energy input is typically by an electric motor. In an air compressor, for example, the maximum work is done at around 80° to 100° before TDC, when the crank arm is substantially normal to the connecting rod. At this position, the compressed gas pressure will be relatively low (less than 50% of maximum), because the volume of the compression chamber is still relatively high. When the piston is nearing TDC, however, its ability to do work is greatly reduced, but the pressure and temperature are both at a maximum. The outlet valve of the compressor would have opened before TDC, but energy would have been lost as heat to the cylinder walls at this time.

If a suitably designed energy storage piston with a spring assembly of the type described above is fitted into this compressor, however, energy would be stored in the spring at around 80° to 100° before TDC, thereby reducing the temperature and pressure of the gas, and hence reducing the energy lost as heat to the cylinder walls and reservoir. The spring assembly would discharge its energy by propelling the gas into the reservoir at around TDC, when the crank arm compressive movement is the least.

Moreover, it can be seen that this spring assembly, working in conjunction with the rotating inertial mass (of the flywheel, crank, etc.), will have an rpm at which they are resonant. By matching the rpm of the drive motor to the resonant rpm, the assembly will run at its optimum efficiency of at least 30% above that of a standard compressor.

It will be apparent that modifications could be made to the piston described above. For example, instead of providing a separate dome-shaped member 7, the internal surface of the piston crown 2 could be shaped to define a domed surface.

The invention claimed is:

1. A piston incorporating spring means acting, in use, between the piston and an associated connecting rod so as to bias the connecting rod away from the crown of the piston, wherein the spring means is constituted by a pair of disc springs whose circumferential edge portions are supported and separated by a substantially annular support member, the spring means being located substantially in the region of the piston crown and extending over substantially the entire transverse cross-section of the piston, the spring means being such as to permit the crown of the piston to move axially relative to the connecting rod, wherein the support member is constituted by respective rings fixed to the circumferential edge portions of the disc springs, and by an annular band formed with curved support surfaces for rolling engagement with the rings.

2. A piston as claimed in claim 1, wherein the rings and the annular band are made of hardened steel.

3. A piston as claimed in claim 1, wherein the annular band is formed with oil lubrication holes.

4. A piston as claimed in claim 1, wherein the spring is made of titanium 10-2-3.

5. A piston as claimed in claim 1, further comprising a carrier positioned within the piston, the carrier being slidably mounted within the piston for axial movement relative thereto, and being connected to the connecting rod in such a manner that the spring means permits the crown of the piston to move axially relative to the carrier.

6. A piston as claimed in claim 5, wherein the carrier is provided with a domed surface, which is engageable with the disc spring remote from the piston crown, and the piston crown is provided with a domed surface, which is engageable with the disc spring adjacent to the piston crown.

7. A piston as claimed in claim 6, wherein the domed surfaces are mirror images of one another.

8. A piston as claimed in, claim 5 wherein the carrier is made of aluminium.

9. A piston as claimed in, claim 5 wherein the carrier is slidably mounted within a sleeve fixed to the inside of the cylindrical wall of the piston at that end thereof remote from the crown.

10. A piston as claimed in claim 9, wherein the sleeve is made of a bronze/aluminium.

11. A piston incorporating spring means acting, in use, between the piston and an associated connecting rod so as to bias the connecting rod away from the crown of the piston, wherein the spring means is constituted by a pair of disc springs whose circumferential edge portions are supported and separated by a substantially annular support member, the spring means being located substantially in the region of the piston crown and extending over substantially the entire transverse cross-section of the piston, the spring means being such as to permit the crown of the piston to move axially relative to the connecting rod, wherein the piston is provided with a domed surface which is engageable with the disc spring remote from the piston crown, and the piston crown is provided with a domed surface which is engageable with the disc spring adjacent to the piston crown.

12. A piston including:

a crown;

a connecting rod; and a spring located between the crown and the connecting rod so as to bias the connecting rod away from the crown, the spring including a pair of disc springs whose circumferential edge portions are supported and separated by a substantially annular support member.

13. The piston as claimed in claim 12, wherein the support member includes rings fixed to the circumferential edge portions of the disc springs.

14. The piston as claimed in claim 13, wherein the support member includes an annular band formed with curved support surfaces for engagement with the rings.

15. The piston as claimed in claim 12, wherein the spring is extends over substantially the entire transverse cross-section of the piston.

* * * * *

UNITED STATES PATENT AND TRADEMARK OFFICE

CERTIFICATE OF CORRECTION

PATENT NO. : 7,334,554 B2
APPLICATION NO. : 10/552981
DATED : February 26, 2008
INVENTOR(S) : George F. Galvin It is certified that error appears in the above-identified patent and that said Letters Patent is hereby corrected as shown below:

Claim 15 - Line 12, delete the word "is"

Signed and Sealed this

Twenty-seventh Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,334,554 B2
APPLICATION NO. : 10/552981
DATED : February 26, 2008
INVENTOR(S) : George F. Galvin It is certified that error appears in the above-identified patent and that said Letters Patent is hereby corrected as shown below:

Column 10, Claim 15, Line 12, delete the word "is"

This certificate supersedes the Certificate of Correction issued May 27, 2008.

Signed and Sealed this

Twenty-fourth Day of June, 2008

JON W. DUDAS
*Director of the United States Patent and Trademark Office*